US007312371B2

(12) United States Patent
Stell et al.

(10) Patent No.: US 7,312,371 B2
(45) **Date of Patent: *Dec. 25, 2007**

(54) STEAM CRACKING OF HYDROCARBON FEEDSTOCKS CONTAINING NON-VOLATILE COMPONENTS AND/OR COKE PRECURSORS

(75) Inventors: Richard C. Stell, Houston, TX (US); Robert D. Strack, Houston, TX (US); James M. Frye, Houston, TX (US); Alok Srivastava, Houston, TX (US); Subramanian Annamalai, Singapore (SG); James N. McCoy, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 638 days.

This patent is subject to a terminal disclaimer.

(21) Appl. No.: 10/851,730

(22) Filed: May 21, 2004

(65) Prior Publication Data

US 2005/0261537 A1 Nov. 24, 2005

(51) Int. Cl.
*C10G 9/14* (2006.01)
*C07C 4/04* (2006.01)

(52) U.S. Cl. ..... 585/652; 585/648; 585/650; 208/132

(58) Field of Classification Search ..... 208/132
See application file for complete search history.

(56) References Cited

U.S. PATENT DOCUMENTS

| | | | | |
|---|---|---|---|---|
| 1,936,699 | A | 11/1933 | Weaver | |
| 1,984,569 | A | 12/1934 | Cooke et al. | 196/66 |
| 2,091,261 | A | 8/1937 | Alther | 196/49 |
| 2,158,425 | A | 5/1939 | Ragatz | 196/73 |
| 3,291,573 | A | 12/1966 | Frescoln | |
| 3,341,429 | A | 9/1967 | Fondrk | |
| 3,413,211 | A | 11/1968 | Becraft et al. | 208/93 |
| 3,487,006 | A | 12/1969 | Newman et al. | 208/93 |
| 3,492,795 | A | 2/1970 | Guerrieri | |
| 3,505,210 | A | 4/1970 | Wallace et al. | |
| 3,617,493 | A | 11/1971 | Wirth et al. | 208/80 |
| 3,677,234 | A | 7/1972 | Dutkiewicz | |
| 3,718,709 | A | 2/1973 | Simonetta | 260/683 R |
| 3,900,300 | A | 8/1975 | Lehman | |
| 4,199,409 | A | 4/1980 | Skraba | |

(Continued)

FOREIGN PATENT DOCUMENTS

DE 10 93 351 11/1960

(Continued)

OTHER PUBLICATIONS

"Specialty Furnace Design: Steam Reformers and Steam Crackers", presented by T.A. Wells of the M.W. Kellogg Company, 1988 AIChE Spring National Meeting.

(Continued)

*Primary Examiner*—Tam M. Nguyen

(57) ABSTRACT

A process for cracking a heavy hydrocarbon feedstock containing non-volatile components and/or coke precursors, wherein a stripping agent is added to the feedstock to form an enhanced hydrocarbon blend which is thereafter separated into a vapor phase and a liquid phase by flashing in a flash/separation vessel, separating and cracking the vapor phase, and recovering cracked product. The stripping agent increases vaporization of the volatile fraction of the heavy hydrocarbon increasing the maximum feedrate capacity of the furnace.

36 Claims, 1 Drawing Sheet

U.S. PATENT DOCUMENTS

| | | | | |
|---|---|---|---|---|
| 4,264,432 | A | 4/1981 | Gartside | 208/48 R |
| 4,300,998 | A | 11/1981 | Gartside | 208/127 |
| 4,311,580 | A | 1/1982 | Bartholic | 208/91 |
| 4,361,478 | A | 11/1982 | Gengler et al. | |
| 4,400,182 | A | 8/1983 | Davies et al. | |
| 4,426,278 | A | 1/1984 | Kosters | 208/130 |
| 4,543,177 | A | 9/1985 | Murthy et al. | 208/130 |
| 4,615,795 | A | 10/1986 | Woebcke et al. | 208/72 |
| 4,714,109 | A | 12/1987 | Tsao | |
| 4,732,740 | A | 3/1988 | Woebcke et al. | 422/193 |
| 4,840,725 | A | 6/1989 | Paspek | 208/130 |
| 4,854,944 | A | 8/1989 | Strong | 48/214 R |
| 4,954,247 | A | 9/1990 | Lipkin et al. | |
| 5,096,567 | A | 3/1992 | Paspek, Jr. et al. | 208/106 |
| 5,120,892 | A | 6/1992 | Skraba | 585/652 |
| 5,141,906 | A | 8/1992 | Takeshima et al. | |
| 5,190,634 | A | 3/1993 | Fernandez-Baujin et al. | 208/107 |
| 5,468,367 | A | 11/1995 | Dickakian et al. | |
| 5,580,443 | A | 12/1996 | Yoshida et al. | 208/130 |
| 5,817,226 | A | 10/1998 | Lenglet | |
| 5,910,440 | A | 6/1999 | Grossman et al. | |
| 6,093,310 | A | 7/2000 | Swan | |
| 6,123,830 | A | 9/2000 | Gupta et al. | |
| 6,179,997 | B1 | 1/2001 | Vedder, Jr. et al. | 208/113 |
| 6,190,533 | B1 | 2/2001 | Bradow et al. | |
| 6,210,561 | B1 | 4/2001 | Bradow et al. | |
| 6,303,842 | B1 | 10/2001 | Bridges et al. | |
| 6,376,732 | B1 | 4/2002 | Ngan et al. | |
| 6,632,351 | B1 | 10/2003 | Ngan et al. | 208/132 |
| 6,743,961 | B2 | 6/2004 | Powers | |
| 2001/0016673 | A1 | 8/2001 | Bridges et al. | |
| 2003/0070963 | A1 | 4/2003 | Zimmermann et al. | |
| 2004/0004022 | A1 | 1/2004 | Stell et al. | 208/106 |
| 2004/0004027 | A1 | 1/2004 | Spicer et al. | 208/130 |
| 2004/0004028 | A1 | 1/2004 | Stell et al. | 208/130 |
| 2004/0039240 | A1 | 2/2004 | Powers | |
| 2004/0054247 | A1 | 3/2004 | Powers | |
| 2005/0010075 | A1 | 1/2005 | Powers | |

FOREIGN PATENT DOCUMENTS

| | | |
|---|---|---|
| EP | 0063448 | 10/1982 |
| FR | 1472280 | 3/1967 |
| GB | 199 766 | 6/1923 |
| GB | 998 504 | 7/1965 |
| GB | 1 053 751 | 1/1967 |
| GB | 1 203 017 | 8/1970 |
| GB | 1 233 795 | 5/1971 |
| GB | 2 006 259 | 10/1977 |
| GB | 2 012 176 | 11/1977 |
| NL | 7410163 | 4/1975 |
| SU | 1491552 | 7/1989 |
| WO | WO 01/55280 | 8/2001 |
| WO | WO 2004/005433 | 1/2004 |
| ZA | 907394 | 7/1991 |

OTHER PUBLICATIONS

Dennis A. Duncan and Vance A. Ham, Stone & Webster, "The Practicalities of Steam-Cracking Heavy Oil", Mar. 29-Apr. 2, 1992, AIChE Spring National Meeting in New Orleans, LA, pp. 1-41.

ABB Lummus Crest Inc., (presentation) HOPS, "Heavy Oil Processing System", Jun. 15, 1992 TCC PEW Meeting, pp. 1-18.

Mitsui Sekka Engineering Co., Ltd./Mitsui Engineering & Shipbuilding Co., Ltd., "Mitsui Advanced Cracker & Mitsui Innovative Quencher", pp. 1-16, 1999.

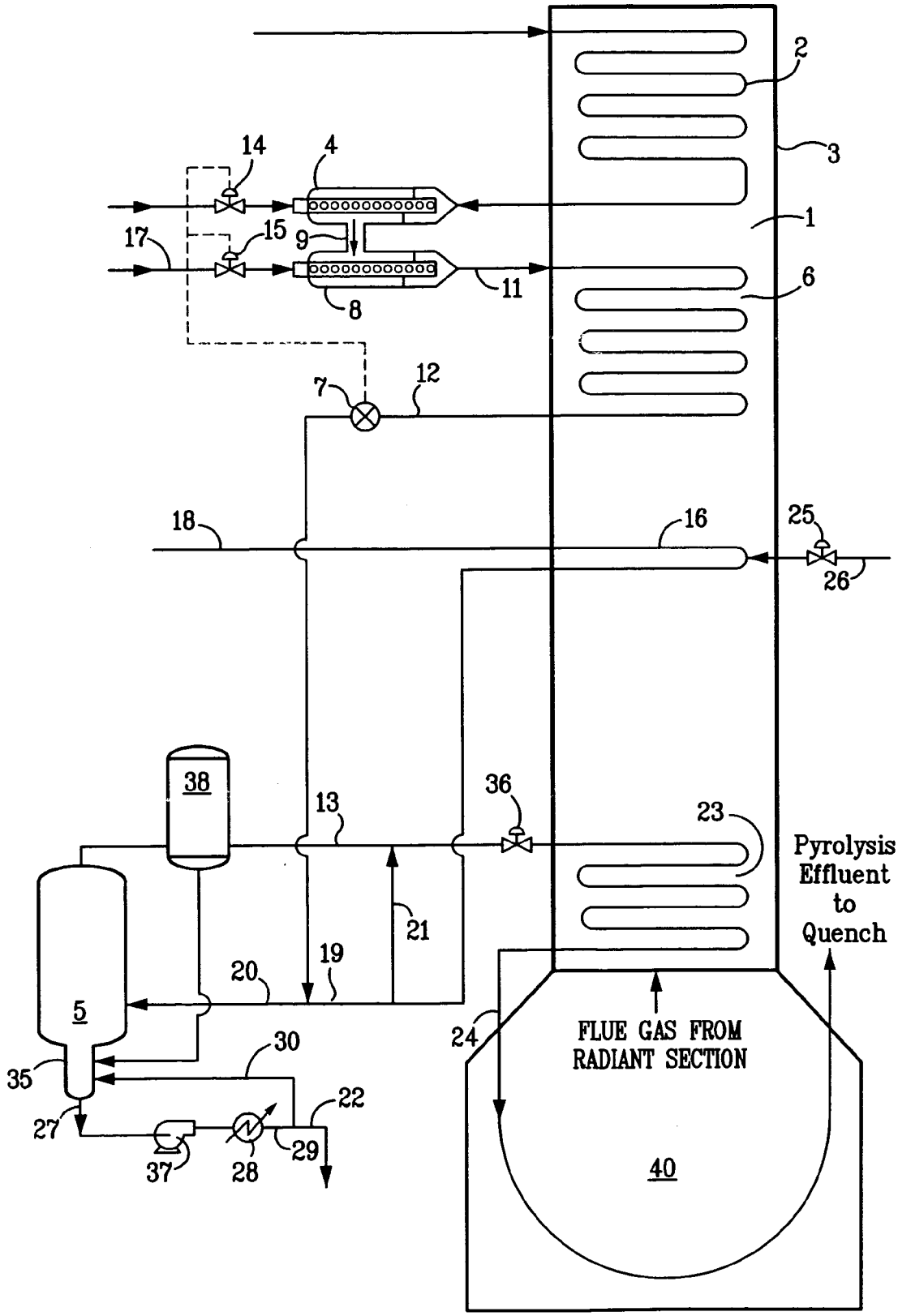
2
3
14
4
1
17
15
9
6
11
8
7
12
18
16
25
26
38
13
36
23
Pyrolysis
Effluent
to
Quench
21
19
20
5
24
FLUE GAS FROM
RADIANT SECTION
30
35
22
27
29
37
28
40

STEAM CRACKING OF HYDROCARBON FEEDSTOCKS CONTAINING NON-VOLATILE COMPONENTS AND/OR COKE PRECURSORS

FIELD OF THE INVENTION

The present invention relates to the steam cracking of hydrocarbons that contain relatively non-volatile components and/or coke precursors.

BACKGROUND

Steam cracking, also referred to as pyrolysis, has long been used to crack various hydrocarbon feedstocks into olefins, preferably light olefins such as ethylene, propylene, and butenes. Conventional steam cracking utilizes a pyrolysis furnace which has two main sections: a convection section and a radiant section. The hydrocarbon feedstock typically enters the convection section of the furnace as a liquid (except for light low molecular weight feedstocks which enter as a vapor) wherein it is typically heated and vaporized by indirect contact with hot flue gas from the radiant section and to a lesser extent by direct contact with steam. The vaporized feedstock and steam mixture is then introduced into the radiant section where the cracking takes place. The resulting products including olefins leave the pyrolysis furnace for further downstream processing, including quenching.

Pyrolysis involves heating the feedstock sufficiently to cause thermal decomposition of the larger molecules. The pyrolysis process, however, produces molecules which tend to combine to form high molecular weight materials known as tar. Tar is a high-boiling point, viscous, reactive material that can foul equipment under certain conditions. In general, feedstocks containing higher boiling materials tend to produce greater quantities of tar.

The formation of tar after the pyrolysis effluent leaves the steam cracking furnace can be minimized by rapidly reducing the temperature of the effluent exiting the pyrolysis unit to a level at which the tar-forming reactions are greatly slowed. This cooling which may be achieved in one or more steps and using one or more methods is referred to as quenching.

Conventional steam cracking systems have been effective for cracking high-quality feedstock which contain a large fraction of light volatile hydrocarbons, such as gas oil and naphtha. However, steam cracking economics sometimes favor cracking lower cost heavy feedstocks such as, by way of non-limiting examples, crude oil, and atmospheric residue. Crude oil and atmospheric residue often contain high molecular weight, non-volatile components with boiling points in excess of about 590° C. (about 1100° F.) otherwise known as asphaltenes, bitumen, or resid. The non-volatile components of these feedstocks lay down as coke in the convection section of conventional pyrolysis furnaces. Only very low levels of non-volatile components can be tolerated in the convection section downstream of the point where the lighter components have fully vaporized.

In most commercial naphtha and gas oil crackers, cooling of the effluent from the cracking furnace is normally achieved using a system of transfer line heat exchangers, a primary fractionator, and a water quench tower or indirect condenser. The steam generated in transfer line exchangers can be used to drive large steam turbines which power the major compressors used elsewhere in the ethylene production unit.

To address coking problems, U.S. Pat. No. 3,617,493, which is incorporated herein by reference, discloses the use of an external vaporization drum for the crude oil feed and discloses the use of a first flash to remove naphtha as vapor and a second flash to remove vapors with a boiling point between 450 and 1100° F. (230 and 590° C.). The vapors are cracked in the pyrolysis furnace into olefins and the separated liquids from the two flash tanks are removed, stripped with steam, and used as fuel.

U.S. Pat. No. 3,718,709, which is incorporated herein by reference, discloses a process to minimize coke deposition. It describes preheating of heavy feedstock inside or outside a pyrolysis furnace to vaporize about 50% of the heavy feedstock with superheated steam and the removal of the residual, separated liquid. The vaporized hydrocarbons, which contain mostly light volatile hydrocarbons, are subjected to cracking.

U.S. Pat. No. 5,190,634, which is incorporated herein by reference, discloses a process for inhibiting coke formation in a furnace by preheating the feedstock in the presence of a small, critical amount of hydrogen in the convection section. The presence of hydrogen in the convection section inhibits the polymerization reaction of the hydrocarbons thereby inhibiting coke formation.

U.S. Pat. No. 5,580,443, which is incorporated herein by reference, discloses a process wherein the feedstock is first preheated and then withdrawn from a preheater in the convection section of the pyrolysis furnace. This preheated feedstock is then mixed with a predetermined amount of steam (the dilution steam) and is then introduced into a gas-liquid separator to separate and remove a required proportion of the non-volatiles as liquid from the separator. The separated vapor from the gas-liquid separator is returned to the pyrolysis furnace for heating and cracking.

U.S. patent application Ser. No. 10/188,461, filed Jul. 3, 2002, which is incorporated herein by reference, describes a process for cracking heavy hydrocarbon feedstock which mixes heavy hydrocarbon feedstock with a fluid, e.g., hydrocarbon or water, to form a mixture stream which is flashed to form a vapor phase and a liquid phase, the vapor phase being subsequently cracked to provide olefins. The amount of fluid mixed with the feedstock is varied in accordance with a selected operating parameter of the process, e.g., temperature of the mixture stream before the mixture stream is flashed, the pressure of the flash, the flow rate of the mixture stream, and/or the excess oxygen in the flue gas of the furnace.

In using a flash to separate heavy liquid hydrocarbon fractions from the lighter fractions which can be processed in the pyrolysis furnace, it is important to effect the separation so that most of the non-volatile components remain in the liquid phase. Otherwise, heavy, coke-forming non-volatile components in the vapor are carried into the lower tube banks of the convection section depositing as coke. Further, it has been noted that the heavier molecules have a tendency to undergo endothermic cracking reactions in the saturated vapor leaving the flash vessel. These endothermic reactions cause cooling which in turn promotes condensation of additional heavy components. Liquids contacting the internal surfaces of the vessel and downstream equipment provide coatings of films that are precursors to coke.

It has now surprisingly been found that the addition of a stripping agent to the heavy hydrocarbon feedstock can increase the percentage of a heavy hydrocarbon feedstock stream available for cracking and can also reduce the formation of coke downstream of the flash/separation vessel and/or increase furnace capacity.

SUMMARY

The present invention relates to a process for cracking a heavy hydrocarbon feedstock containing non-volatile hydrocarbons and/or coke precursors. The process comprises: (a) adding a stripping component to the heavy hydrocarbon feedstock to form an enhanced hydrocarbon feedstock blend; (b) heating the enhanced hydrocarbon feedstock blend; (c) feeding the enhanced hydrocarbon feedstock blend to a flash/separation vessel; (d) separating the enhanced hydrocarbon feedstock blend into a non-volatile component and coke precursor depleted vapor phase and a liquid phase rich in non-volatile components and/or coke precursors; (e) removing the vapor phase from the flash/separation vessel; (f) cracking the vapor phase in a radiant section of a pyrolysis furnace to produce an effluent comprising olefins, the pyrolysis furnace comprising a radiant section and a convection section. Steam, which may optionally comprise sour or treated process steam and may optionally be superheated, may be added at any step or steps in the process prior to cracking the vapor phase.

The addition of stripping agent enables cracking a higher fraction of the heavy hydrocarbon feedstock, such as greater than 1% more, for example greater than 10% more; reduces fouling in and downstream of said flash/separation vessel, and/or increases the capacity of the pyrolysis furnace, such as by at least 10%, for example by at least 20%; all as compared to using a feedstock comprising only the heavy hydrocarbon feedstock containing non-volatile components and/or coke precursors. Preferably the stripping agent reduces the $T_{50}$ of the enhanced hydrocarbon feedstock blend by at least about 15° C. (about 25° F.) from the $T_{50}$ of the heavy hydrocarbon feedstock, for example by at least about 28° C. (about 50° F.).

The stripping agent generally comprises between about 2 wt. % and about 95 wt. % of the enhanced hydrocarbon feedstock blend, for example between 10 wt. % and about 80 wt. % of the enhanced hydrocarbon feedstock blend, such as between about 20 wt. % and about 50 wt. % of the enhanced hydrocarbon feedstock blend.

Preferably, the enhanced hydrocarbon feedstock blend with non-volatile components and/or coke precursors is heated by indirect contact with flue gas in a first convection section tube bank of the pyrolysis furnace, for example to about 150 to about 340° C. (about 300 to about 650° F.), before optionally mixing with steam. The enhanced hydrocarbon feedstock blend may also be mixed with a fluid, such as hydrocarbon or water, in addition to the steam. The preferred fluid is water.

The enhanced hydrocarbon feedstock blend may be further heated by indirect contact with flue gas in a second convection section tube bank of the pyrolysis furnace before being flashed. Preferably, the temperature of the enhanced hydrocarbon feedstock blend before separation in step (d) is from about 315 to about 560° C. (about 600 to about 1040° F.). Preferably the separation in step (d) is at a pressure of from about 275 to about 1380 kPa (about 40 to about 200 psia). Generally, about 50 to about 98 percent of the hydrocarbon feedstock is in the vapor phase after being flashed. Additionally, steam may be added to the vapor phase in the top portion of the flash/separation vessel and/or downstream of the flash/separation vessel before step (f).

If desired, the vapor phase may be sent through an additional separation step to remove trace amounts of liquid before step (f). The preferred vapor phase temperature entering the radiant section of the pyrolysis furnace is from about 425 to about 705° C. (about 800 to about 1300° F.), which may optionally be attained by additional heating in a convection section tube bank, preferably the bank nearest the radiant section of the furnace.

BRIEF DESCRIPTION OF THE DRAWINGS

FIG. 1 illustrates a schematic flow diagram of the overall process and apparatus in accordance with the present invention employed with a pyrolysis furnace.

DETAILED DESCRIPTION

Unless otherwise stated, all percentages, parts, ratios, etc. are by weight. Unless otherwise stated, a reference to a compound or component includes the compound or component by itself, as well as in combination with other compounds or components, such as mixtures of compounds.

Further, when an amount, concentration, or other value or parameter is given as a list of upper preferable values and lower preferable values, this is to be understood as specifically disclosing all ranges formed from any pair of an upper preferred value and a lower preferred value, regardless of whether ranges are separately disclosed.

As used herein, non-volatile components are the fraction of a hydrocarbon stream with a nominal boiling point above about 590° C. (about 1100° F.) as measured by ASTM D-6352-98 or D-2887. This invention works very well with non-volatile components having a nominal boiling point above about 760° C. (about 1400° F.). The boiling point distribution of the hydrocarbon stream is measured by Gas Chromatograph Distillation (GCD) according to the methods described in ASTM D-6352-98 or D-2887, extended by extrapolation for materials boiling above 700° C. (1292° F.). Non-volatile components can include coke precursors, which are moderately heavy and/or reactive molecules, such as multi-ring aromatic compounds, which can condense from the vapor phase and then form coke under the operating conditions encountered in the present process of the invention. $T_{50}$ as used herein shall mean the temperature, determined according to the boiling point distribution described above, at which 50 weight percent of a particular sample has reached its boiling point. Nominal final boiling point shall mean the temperature at which 99.5 weight percent of a particular sample has reached its boiling point.

The heavy hydrocarbon feedstock for use with this invention comprises non-volatile components and/or coke precursors. The heavy hydrocarbon feedstock for use with the present invention typically comprises one or more of steam cracked gas oil and residues, crude oil, atmospheric pipestill bottoms, vacuum pipestill streams including bottoms, heavy non-virgin hydrocarbon streams from refineries, vacuum gas oils, low sulfur waxy residue, atmospheric residue, and heavy residue. The ideal heavy hydrocarbon feedstock is an economically advantaged, minimally processed heavy hydrocarbon stream containing non-volatile hydrocarbons and coke precursors.

The stripping agent for use in the present invention typically comprises one or more of gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, wide boiling range naphtha to gas oil condensates, heavy gas oil, naphtha contaminated with crude, natural gas liquids, mixed C4 components, hydrocarbon gases, butanes, propane, ethane, and hydrogen. It is noted that since the stripping agent will be blended with a heavy hydrocarbon feedstock, quality of the stripping agent, as defined by boiling point range, is not a concern. Economically advantaged streams such as off-spec and contaminated streams, for example crude-contaminated naphtha or condensate, are ideal for use as stripping agents in this invention.

The stripping agent will preferably have a lower molecular weight and a lower $T_{50}$ boiling point than the heavy hydrocarbon feedstock, but may have a nominal final boiling point below, equal to, or greater than the nominal final boiling point of the heavy hydrocarbon feedstock. Likewise the initial boiling point of the stripping agent may be lower than, equal to, or greater than the initial boiling point of the heavy hydrocarbon feedstock. If the heavy hydrocarbon feedstock is an atmospheric bottoms stream, the stripping agent will preferably have a lower initial boiling point.

Preferably, the weighted average molecular weight of the stripping agent will be at least about 20% less than the weighted average molecular weight of the heavy hydrocarbon feedstock, such as at least about 25% less, for example at least about 35% less, and as a further example at least about 50% less.

Preferably, the addition of the stripping agent will result in an enhanced hydrocarbon feedstock blend with a $T_{50}$ boiling point at least about 15° C. (about 25° F.) lower than the $T_{50}$ boiling point of the heavy hydrocarbon feedstock, such as at least about 28° C. (about 50° F.), for example at least about 56° C. (about 100° F.) lower, as a further example at least about 111° C. (about 200° F.) lower, and as yet another example at least about 167° C. (about 300° F.) lower.

Vapor-liquid equilibrium modeling using computer software, such as PROvision™ by Simulation Sciences Inc., can be used to determine optimal quantities of a given stripping agent for use with a given heavy hydrocarbon feedstock.

The present invention relates to a process for heating and steam cracking hydrocarbon feedstock containing non-volatile hydrocarbons. The process comprises mixing a heavy hydrocarbon feedstock with a stripping agent to form an enhanced hydrocarbon feedstock blend, heating the enhanced hydrocarbon feedstock blend, flashing the enhanced hydrocarbon feedstock blend to form a vapor phase and a liquid phase, feeding the vapor phase to the radiant section of a pyrolysis furnace, and producing an effluent comprising olefins.

The addition of steam at various points in the process is known in the art and will, for simplicity, not be detailed in every description herein. It is further noted that any of the steam added may comprise sour or treated process steam and that any of the steam added, whether sour or not, may be superheated. Superheating is preferable when the steam comprises sour steam. Since steam and other fluids may be added at various points, the description herein will use the term "enhanced hydrocarbon feedstock blend" to mean the combined components of the stripping agent and the heavy hydrocarbon feedstock together as they travel through the process regardless of what quantities of steam and other fluids may also be present at any given stage in the process.

When heavy hydrocarbon feedstock containing non-volatile components and/or coke precursors is cracked, the feed is preheated in the upper convection section of a pyrolysis furnace, optionally mixed with a fluid such as water, and then further preheated in the convection section, where the majority of the heavy hydrocarbon feedstock vaporizes forming a vapor phase substantially depleted of the non-volatile components and/or coke precursors. It is understood that vapor-liquid equilibrium at the operating conditions described herein would result in small quantities of non-volatile components and/or coke precursors present in the vapor phase. Additionally, and varying with the design of the flash/separation vessel, minute quantities of liquid containing non-volatile components and/or coke precursors could be entrained in the vapor phase.

The resulting hydrocarbon/steam vapor phase is at its dew point and is hot enough for cracking of heavier hydrocarbon components (including, but not limited to, non-volatile components and coke precursors) to occur. This cracking can result in the formation of reactive heavy hydrocarbons which may deposit on the surfaces of piping and equipment downstream of the flash/separation vessel, eventually forming coke.

The cracking reaction is endothermic, reducing the vapor temperature, for example by about 8° C. (about 15° F.) to about 12° C. (about 22° F.) or more, before the vapor is further preheated in the lower convection section and then cracked in the radiant section of the furnace. Simultaneously, some heat loss to the surroundings further cools the vapor. These cooling effects can cause a portion of the heaviest hydrocarbon to condense. The condensed hydrocarbon dehydrogenates into foulant (e.g. polynuclear aromatics) that collects in piping and equipment immediately downstream of the flash/separation vessel and limits both the time between decoking treatments and the maximum temperature in the flash/separation apparatus. The reduction in flash/separation temperature limits the hydrocarbon feedrate because the vapor fraction is reduced. Microscopic analysis of the foulant indicates it is derived from liquid hydrocarbon.

One solution to this problem is proposed in co-pending application Ser. No. 10/851,878, filed May 21, 2004, which describes the addition of a heated vaporous diluent to the flash/separation vessel to reduce the condensation. Such a solution can advantageously be implemented in conjunction with many embodiments of the present invention.

Rather than cracking a heavy hydrocarbon feedstock as it is delivered, it has been found to be advantageous to blend the feedstock with a stripping agent comprising a lighter hydrocarbon stream. Multiple synergistic effects can be realized with such a procedure.

It will be recognized that economic considerations would generally favor maximizing the fraction of the feedstock which is in the vapor phase and subsequently cracked. One of the benefits which can be realized by the addition of a stripping agent to the heavy hydrocarbon feedstock is an increase in the percentage of the heavier hydrocarbon feedstock vaporized at a given flash temperature with negligible quantities of the stripping agent retained in the liquid phase. For example, a mixture of 35% heavy atmospheric gas oil (stripping agent) with 65% low sulfur waxy residue (an atmospheric bottoms fraction) could result in an increase from 73% to 78% of the low sulfur waxy residue vaporized in the flash/separation vessel with negligible quantities of the heavy atmospheric gas oil remaining in the liquid phase. Any increase in vaporization of the heavy hydrocarbon feedstock at a given separation temperature would generally improve process economics. Application of the inventive process described herein would be expected to result in an increase in the percentage of heavy hydrocarbon feedstock vaporized at given separator conditions, for example an increase in the percentage of heavy hydrocarbon feedstock vaporized of at least about 1%, for another example at least about 5%, as a further example at least about 10%, and as yet another example at least about 20%, or even at least about 30%.

In another embodiment, rather than maximizing the percentage of the heavy hydrocarbon feedstock in the vapor phase, the separation vessel could be operated to achieve a given vapor/liquid split at a lower temperature thereby reducing the rate of endothermic cracking reactions, which in turn reduces the vapor phase temperature drop and the resultant condensation of liquid coke precursors. The temperature reduction at a given vapor/liquid split could be about 8° C. (about 15° F.). The dilution effect of the lighter hydrocarbon molecules added by the stripping agent further reduces the rate of cracking. Further the reduction in overhead temperature drop could be greater than about 1° C. (about 2° F.), such as greater than about 3° C. (about 5° F.), for example greater than about 5° C. (about 9° F.). Although a reduction in temperature drop in the vapor phase would be expected whether the separation temperature or the vapor fraction was held constant, it would be more pronounced if the vapor fraction were held constant.

The stripping agent added to the heavy hydrocarbon feedstock may be from about 2 to about 95 percent of the resultant hydrocarbon feedstock stream, such as from about 5% to about 90%, for example from about 10% to about 80%, as a further example from about 20% to about 70%. The percentage of the stripping agent added to the heavy hydrocarbon feedstock would preferably be optimized according to economics and availability of given hydrocarbon streams at any particular time. In general, the lighter the stripping agent is relative to the heavy hydrocarbon feedstock being used, the less stripping agent will be required for optimal benefit.

Depending on tankage available, the stripping agent may be added to the heavy hydrocarbon feedstock in the feedstock storage tanks or at any point prior to introduction of the heavy hydrocarbon feedstock to the convection section of the furnace. The stripping agent may be a liquid or a vapor at the point of mixing, preferably a liquid if it is added in or upstream of the storage tanks. An additional benefit of adding a stripping agent as described herein can be a reduction in viscosity of the heavy hydrocarbon feedstock, thereby reducing the temperature required to allow the feedstock to flow from the tankage to the pyrolysis process area. If the heavy hydrocarbon feedstock is passed through a desalter, adding the stripping agent upstream of the desalter reduces the viscosity of the fluid, improving desalter efficiency and increasing desalter capacity.

The reduced viscosity of the enhanced hydrocarbon feedstock blend increases heat transfer and thermal efficiency in the convection section of the furnace. A further benefit is realized in reduced steam requirements, which increases net feedstock throughput and olefins production.

After blending the heavy hydrocarbon feedstock with a stripping agent to produce an enhanced hydrocarbon feedstock blend, the heating of the enhanced hydrocarbon feedstock blend can take any form known by those of ordinary skill in the art. However, it is preferred that the heating comprises indirect contact of the enhanced hydrocarbon feedstock blend in the upper (farthest from the radiant section) convection section tube bank 2 of the furnace 1 with hot flue gases from the radiant section of the furnace. This can be accomplished, by way of non-limiting example, by passing the enhanced hydrocarbon feedstock blend through a bank of heat exchange tubes 2 located within the convection section 3 of the furnace 1. The heated hydrocarbon feedstock typically has a temperature between about 150 and about 340° C. (about 300 and about 650° F.), such as about 160 to about 230° C. (about 325 to about 450° F.), for example about 170 to about 220° C. (about 340 to about 425° F.).

The heated hydrocarbon feedstock is preferably mixed with primary dilution steam and, optionally, a fluid which can be a hydrocarbon, preferably liquid but optionally vapor; water; steam; or a mixture thereof. The preferred fluid is water. A source of the fluid can be low pressure boiler feed water. The temperature of the fluid can be below, equal to, or above the temperature of the heated feedstock. In one possible embodiment, the fluid latent heat of vaporization can be used to control the mixture stream temperature.

The mixing of the heated hydrocarbon feedstock, primary dilution steam, and the optional fluid can occur inside or outside the pyrolysis furnace 1, but preferably it occurs outside the furnace. The mixing can be accomplished using any mixing device known within the art. For example, it is possible to use a first sparger 4 of a double sparger assembly 9 for the mixing. The first sparger 4 can avoid or reduce hammering, caused by sudden vaporization of the fluid, upon introduction of the fluid into the heated hydrocarbon feedstock.

The use of steam and or fluid added to the enhanced hydrocarbon feedstock blend is optional for high volatility feedstocks, possibly including the enhanced hydrocarbon feedstock blend used in the process of this invention. It is possible that such feedstocks can be heated in any manner known in the industry, for example in heat exchange tubes 2 located within the convection section 3 of the furnace 1. The enhanced hydrocarbon feedstock blend could be conveyed to the flash/separation vessel with little or no added steam or fluid.

In applying this invention, the resulting mixture stream can be heated by indirect contact with flue gas in another portion of the first convection section tube bank of the pyrolysis furnace before being flashed.

A second optional fluid can be added to the mixture stream before flashing the mixture stream, the second fluid being a hydrocarbon vapor.

In one embodiment of the present invention, in addition to the fluid mixed with the heated feedstock, primary dilution steam 17 is also mixed with the feedstock. The primary dilution steam stream can be preferably injected into a second sparger 8. It is preferred that the primary dilution steam stream is injected into the hydrocarbon fluid mixture before the resulting stream mixture optionally enters the convection section at 11 for additional heating by flue gas, generally within the same tube bank as would have been used for the initial heating of the enhanced hydrocarbon feedstock blend.

The primary dilution steam can have a temperature greater, lower or about the same as hydrocarbon feedstock fluid mixture but preferably the temperature is about the same as that of the mixture. The primary dilution steam may be superheated before being injected into the second sparger 8.

The mixture stream comprising the heated hydrocarbon feedstock, the fluid, and the optional primary dilution steam stream leaving the second sparger 8 is optionally heated further in the convection section of the pyrolysis furnace 3 before the flash. The heating can be accomplished, by way of non-limiting example, by passing the mixture stream through a bank of heat exchange tubes 6 located within the convection section, usually as a lower part of the first convection section tube bank, of the furnace and thus heated by the hot flue gas from the radiant section of the furnace. The thus-heated mixture stream leaves the convection section as a mixture stream 12 to optionally be further mixed with an additional steam stream.

Optionally, the secondary dilution steam stream 18 can be further split into a flash steam stream 19 which is mixed with the hydrocarbon mixture 12 before the flash and a bypass steam stream 21 which bypasses the flash of the hydrocarbon mixture and, instead is mixed with the vapor phase from the flash before the vapor phase is further heated in the lower convection section and cracked in the radiant section of the furnace. The present invention can operate with all secondary dilution steam 18 used as flash steam 19 with no bypass steam 21. Alternatively, the present invention can be operated with secondary dilution steam 18 directed to bypass steam 21 with no flash steam 19. In a preferred embodiment in accordance with the present invention, the ratio of the flash steam stream 19 to bypass steam stream 21 should be preferably 1:20 to 20:1, and most preferably 1:2 to 2:1. In this embodiment, the flash steam 19 is mixed with the hydrocarbon mixture stream 12 to form a flash stream 20 before the flash in flash/separation vessel 5. Preferably, the secondary dilution steam stream is superheated in a superheater section 16 in the furnace convection before splitting and mixing with the hydrocarbon mixture. The addition of the flash steam stream 19 to the hydrocarbon mixture stream 12 aids the vaporization of less volatile components of the mixture before the flash stream 20 enters the flash/separation vessel 5.

The mixture stream 12 or the flash stream 20 is then flashed, for example in a flash/separation vessel 5, for separation into two phases: a vapor phase comprising predominantly stripping agent, volatile hydrocarbons from the heavy hydrocarbon feedstock, and steam and a liquid phase comprising less-volatile hydrocarbons along with a significant fraction of the non-volatile components and/or coke precursors. It is understood that vapor-liquid equilibrium at the operating conditions described herein would result in small quantities of non-volatile components and/or coke precursors present in the vapor phase. Additionally, and varying with the design of the flash/separation vessel, minute quantities of liquid containing non-volatile components and/or coke precursors could be entrained in the vapor phase.

For ease of description herein, the term flash/separation vessel will be used to mean any vessel or vessels used to separate the enhanced hydrocarbon feedstock blend into a vapor phase and at least one liquid phase. It is intended to include fractionation and any other method of separation, for example, but not limited to, drums, distillation towers, and centrifugal separators.

The mixture stream 12 is preferably introduced tangentially to the flash/separation vessel 5 through at least one side inlet located in the side of said vessel, and the vapor phase is preferably removed from the flash/separation vessel as an overhead vapor stream 13. The vapor phase, preferably, is fed back to a convection section tube bank 23 of the furnace, preferably the bank located nearest the radiant section of the furnace, for optional heating and then through crossover pipes 24 to the radiant section 40 of the pyrolysis furnace for cracking. The liquid phase of the flashed mixture stream is removed from the flash/separation vessel 5, preferably as a bottoms stream 27.

It is preferred to maintain a predetermined constant ratio of vapor to liquid in the flash/separation vessel 5, but such ratio is difficult to measure and control. As an alternative, temperature of the mixture stream 12 before the flash/separation vessel 5 can be used as an indirect parameter to measure, control, and maintain an approximately constant vapor to liquid ratio in the flash/separation vessel 5. Ideally, when the mixture stream temperature is higher, more volatile hydrocarbons will be vaporized and become available, as part of the vapor phase, for cracking. However, when the mixture stream temperature is too high, more heavy hydrocarbons, including coke precursors, will be present in the vapor phase and carried over to the convection furnace tubes, eventually coking the tubes. If the mixture stream 12 temperature is too low, resulting in a low ratio of vapor to liquid in the flash/separation vessel 5, more volatile hydrocarbons will remain in liquid phase and thus will not be available for cracking.

The mixture stream temperature is controlled to maximize recovery or vaporization of volatiles in the feedstock while avoiding excessive coking in the furnace tubes or coking in piping and vessels conveying the mixture from the flash/separation vessel to the furnace 1 via line 13. The pressure drop across the piping and vessels 13 conveying the mixture to the lower convection section 23, and the crossover piping 24, and the temperature rise across the lower convection section 23 may be monitored to detect the onset of coking problems. For instance, if the crossover pressure and process inlet pressure to the lower convection section 23 begin to increase rapidly due to coking, the temperature in the flash/separation vessel 5 and the mixture stream 12 should be reduced. If coking occurs in the lower convection section, the temperature of the flue gas to the higher sections, such as the optional superheater 16, increases. If a superheater 16 is present, the increased flue gas temperature can be offset in part by adding more desuperheater water 26.

The selection of the mixture stream 12 temperature is also determined by the composition of the feedstock materials. When the feedstock contains higher amounts of lighter hydrocarbons, the temperature of the mixture stream 12 can be set lower. When the feedstock contains a higher amount of less- or non-volatile hydrocarbons, the temperature of the mixture stream 12 should be set higher.

Typically, the temperature of the mixture stream 12 can be set and controlled at between about 315 and about 540° C. (about 600 and about 1000° F.), such as between about 370 and about 510° C. (about 700 and about 950° F.), for example between about 400 and about 480° C. (about 750 and about 900° F.), and often between about 430 and about 475° C. (about 810 and about 890° F.). These values will change with the volatility of the feedstock as discussed above.

Considerations in determining the temperature include the desire to maintain a liquid phase to reduce the likelihood of coke formation on exchanger tube walls and in the flash/separation vessel and associated piping. Typically, at least about 2 percent of the mixture stream is in the liquid phase after being flashed.

It is desirable to maintain a constant temperature for the mixture stream 12 mixing with flash steam 19 and entering the flash/separation vessel to achieve a constant ratio of vapor to liquid in the flash/separation vessel 5, and to avoid substantial temperature and flash vapor to liquid ratio variations. One possible control arrangement is the use of a control system 7 to automatically control the fluid valve 14 and primary dilution steam valve 15 on the two spargers. When the control system 7 detects a drop of temperature of the mixture stream, it will cause the fluid valve 14 to reduce the injection of the fluid into the first sparger 4. If the temperature of the mixture stream starts to rise, the fluid valve will be opened wider to increase the injection of the fluid into the first sparger 4.

When the primary dilution steam stream 17 is injected to the second sparger 8, the temperature control system 7 can also be used to control the primary dilution steam valve 15 to adjust the amount of primary dilution steam stream injected to the second sparger 8. This further reduces the sharp variation of temperature changes in the flash 5. When the control system 7 detects a drop of temperature of the mixture stream 12, it will instruct the primary dilution steam valve 15 to increase the injection of the primary dilution steam stream into the second sparger 8 while valve 14 is closed more. If the temperature starts to rise, the primary dilution steam valve will automatically close more to reduce the primary dilution steam stream injected into the second sparger 8 while valve 14 is opened wider.

In an example embodiment where the fluid is water, the controller varies the amount of water and primary dilution steam to maintain a constant mixture stream temperature 12, while maintaining a constant ratio of $H_2O$ to feedstock in the mixture 11. To further avoid sharp variation of the flash temperature, the present invention also preferably utilizes an intermediate desuperheater 25 in the superheating section of the secondary dilution steam in the furnace. This allows the superheater 16 outlet temperature to be controlled at a constant value, independent of furnace load changes, coking extent changes, excess oxygen level changes, and other variables. Normally, this desuperheater 25 maintains the temperature of the secondary dilution steam between about 425 and about 590° C. (about 800 and about 1100° F.), for example between about 455 and about 540° C. (about 850 and about 1000° F.), such as between about 455 and about 510° C. (about 850 and about 950° F.), and typically between about 470 and about 495° C. (about 875 and about 925° F.). The desuperheater can be a control valve and water atomizer nozzle. After partial preheating, the secondary dilution steam exits the convection section and a fine mist of water 26 can be added which rapidly vaporizes and reduces the temperature. The steam is preferably then further heated in the convection section. The amount of water added to the superheater can control the temperature of the steam which is mixed with mixture stream 12.

In addition to maintaining a constant temperature of the mixture stream 12 entering the flash/separation vessel, it is generally also desirable to maintain a constant hydrocarbon partial pressure of the flash stream 20 in order to maintain a constant ratio of vapor to liquid in the flash/separation vessel. By way of examples, the constant hydrocarbon partial pressure can be maintained by maintaining constant flash/separation vessel pressure through the use of control valves 36 on the vapor phase line 13, and by controlling the ratio of steam to hydrocarbon feedstock in stream 20.

Typically, the hydrocarbon partial pressure of the flash stream in the present invention is set and controlled at between 25 and 175 kPa (about 4 and about 25 psia), such as between 35 and 100 kPa (about 5 and about 15 psia), for example between 40 and 75 kPa (about 6 and about 11 psia).

In one embodiment, the flash is conducted in at least one flash/separation vessel. Typically the flash is a one-stage process with or without reflux. The flash/separation vessel 5 is normally operated at about 275 to about 1400 kPa (about 40 to about 200 psia) pressure and its temperature is usually the same or slightly lower than the temperature of the flash stream 20 before entering the flash/separation vessel 5, typically about 315 to about 560° C. (about 600 to about 1040° F.). For example, the pressure of the flash can be about 600 to about 1100 kPa (about 85 to about 155 psia) and the temperature can be about 370 to about 490° C. (about 700 to about 920° F.). As a further example, the pressure of the flash can be about 700 to about 1000 kPa (about 105 to about 145 psia) with a temperature of about 400 to about 480° C. (about 750 to about 900° F.). In yet another example, the pressure of the flash/separation vessel can be about 700 to about 760 kPa (about 105 to about 125 psia) and the temperature can be about 430 to about 475° C. (about 810 to about 890° F.). Depending on the temperature of the mixture stream 12, generally about 50 to about 98% of the mixture stream being flashed is in the vapor phase, such as about 60 to about 95%, for example about 65 to about 90%.

The flash/separation vessel 5 is generally operated, in one aspect, to minimize the temperature of the liquid phase at the bottom of the vessel because too much heat may cause coking of the non-volatiles in the liquid phase. Use of the secondary dilution steam stream 18 in the flash stream entering the flash/separation vessel lowers the vaporization temperature because it reduces the partial pressure of the hydrocarbons (i.e., a larger mole fraction of the vapor is steam) and thus lowers the required liquid phase temperature. It may also be helpful to recycle a portion of the externally cooled flash/separation vessel bottoms liquid 30 back to the flash/separation vessel to help cool the newly separated liquid phase at the bottom of the flash/separation vessel 5. Stream 27 can be conveyed from the bottom of the flash/separation vessel 5 to the cooler 28 via pump 37. The cooled stream 29 can then be split into a recycle stream 30 and export stream 22. The temperature of the recycled stream would typically be about 260 to about 315° C. (about 500 to about 600° F.), for example about 270 to about 290° C. (about 520 to about 550° F.). The amount of recycled stream can be about 80 to about 250% of the amount of the newly separated bottom liquid inside the flash/separation vessel, such as 90 to 225%, for example 100 to 200%.

The flash is generally also operated, in another aspect, to minimize the liquid retention/holding time in the flash/separation vessel. In one example embodiment, the liquid phase is discharged from the vessel through a small diameter "boot" or cylinder 35 on the bottom of the flash/separation vessel. Typically, the liquid phase retention time in the flash/separation vessel is less than about 75 seconds, for example less than about 60 seconds, such as less than about 30 seconds, and often less than about 15 seconds. The shorter the liquid phase retention/holding time in the flash/separation vessel, the less coking occurs in the bottom of the flash/separation vessel.

The vapor phase leaving the flash/separation vessel may contain, for example, about 55 to about 70% hydrocarbons and about 30 to about 45% steam. The nominal boiling end point of the vapor phase is normally below about 760° C. (about 1400° F.), such as below about 590° C. (about 1100° F.), for example below about 565° C. (about 1050° F.), and often below about 540° C. (about 1000° F.). The vapor phase is continuously removed from the flash/separation vessel 5 through an overhead pipe, which optionally conveys the vapor to a centrifugal separator 38 to remove trace amounts of entrained and/or condensed liquid. The vapor then typically flows into a manifold that distributes the flow to the convection or radiant section of the furnace.

The vapor phase stream 13 continuously removed from the flash/separation vessel is preferably superheated in the pyrolysis furnace lower convection section 23 to a temperature of, for example, about 425 to about 705° C. (about 800 to about 1300° F.) by the flue gas from the radiant section of the furnace. The vapor phase is then introduced to the radiant section of the pyrolysis furnace to be cracked to produce an effluent comprising olefins, including ethylene and other desired light olefins, and byproducts.

The vapor phase stream 13 removed from the flash/separation vessel can optionally be mixed with a bypass steam stream 21 before being introduced into the furnace lower convection section 23.

Because the process of this invention results in significant removal of the coke- and tar-producing heavier hydrocarbon species (in the liquid phase 27 leaving the flash/separation vessel 5), it may be possible to utilize a transfer line exchanger for quenching the effluent from the radiant section of the pyrolysis furnace. Among other benefits, this will allow more cost-effective retrofitting of cracking facilities initially designed for lighter feeds, such as naphthas, or other liquid feedstocks with end boiling points generally below about 315° C. (about 600° F.), which have transfer line exchanger quench systems already in place. Co-pending U.S. Provisional Patent Application Ser. No. 60/555,282, filed Mar. 22, 2004, details a design for maximizing the benefits associated with use of a transfer line exchanger in conjunction with a process for cracking hydrocarbon feedstocks comprising non-volatile components.

The location and operating temperature of the flash/separation vessel is selected to provide the maximum possible vapor feed which can be processed without excessive fouling/coking concerns. If the ratio of liquid is too high, valuable feed will be lost and the economics of the operation will be detrimentally affected. If the ratio of liquid is too low, coking in the flash/separation vessel and the associated piping becomes a problem. Additionally, operation at too low a liquid ratio could allow coke precursors from the heavy ends of the hydrocarbon feed stream to enter the high temperature sections of the furnace and cause accelerated coking.

The percentage of given hydrocarbon feed discharged from the flash/separation vessel as a vapor is a function of the hydrocarbon partial pressure in the vessel and of the temperature entering the vessel. The temperature of the enhanced hydrocarbon feedstock blend entering the flash/separation vessel is highly dependent on the flue-gas temperature at that point in the convection section. This temperature will vary as the furnace load is changed, being higher when the furnace is at full load, and lower when the furnace is at partial load. The flue-gas temperature in the first convection section tube bank is also a function of the extent of coking that has occurred in the furnace. When the furnace is clean or lightly coked, heat transfer is improved and the flue-gas temperature at that point is correspondingly cooler than when the furnace is heavily coked. The flue-gas temperature at any point is also a function of the combustion control exercised on the burners of the furnace. When the furnace is operated with low levels of excess oxygen in the flue-gas the flue-gas temperature at any point will be correspondingly lower than when the furnace is operated with higher levels of excess oxygen in the flue-gas.

Total furnace load is determined by the heat requirements for pyrolysis in the radiant section of the furnace as well as heat requirements in the convection section. Excess oxygen above about 2% is in essence a reflection of extra air volumes being heated in the radiant section of the furnace to provide for the heat needed in the convection section. Pyrolysis capacity is limited by the heat output capabilities of the furnace and efficiency with which that heat is utilized. The ultimate limitation on furnace capacity is the flue gas volume, therefore minimizing the excess oxygen (with the accompanying nitrogen) allows greater capacity for heat generation. Improved heat transfer in both the radiant and convection sections and reduced heating requirements associated with the use of a stripping agent will allow total pyrolysis throughput to be increased.

The total energy requirement in the convection section is the sum of the energy required to vaporize the hydrocarbon stream to a desired cutpoint, vaporize and superheat any water used for flash temperature control, superheat the hydrocarbon vapor, and superheat the dilution steam. This total energy requirement exceeds that energy available when running typical combustion air rates. To increase the heat input without raising the heat input to the radiant section, the combustion air rate must be raised to a level that is beyond the combustion requirements. When heavy hydrocarbon feedstock is used alone, additional air (above the combustion requirements) is mixed with the fuel and combusted to provide the necessary heat input to vaporize the heavy hydrocarbon feedstock and optional water. This additional combustion air requires additional fuel to maintain the desired radiant section temperature and therefore results in reduced furnace thermal efficiency. The heated excess air provides additional heat to the convection section, but in doing so it requires that a portion of the flue gas capacity be used for excess air rather than radiant section heating, thereby limiting the radiant section cracking capacity.

Co-pending application Ser. No. 10/851,495, filed May 21, 2004 describes a novel control system that uses the draft in the furnace to control the temperature of the process stream entering the flash/separation vessel. Little or no water is used in this new control scheme. By removing the water, the energy required in the convection section is reduced (no energy required to vaporize the water), and thus it is possible to reduce the combustion air levels—and hence reduce the fuel fired. This control mechanism may be used in conjunction with the present invention.

In the present invention, by increasing the amount of hydrocarbon vaporized at a given temperature, the addition of a stripping agent to the heavy hydrocarbon feedstock reduces the energy consumption per ton of hydrocarbon feed and increases the hydrocarbon processing capacity of the furnace.

Furnace operations between decokes can cause fluctuations in the flash/separation vessel temperature resulting in fluctuations in both the fraction of hydrocarbon that is a vapor in the flash/separation vessel and radiant hydrocarbon feed rate causing unstable furnaces operations. Sometimes this instability can be counter-intuitive. With the addition of a stripping agent allowing a higher vapor cut with less heat input, increasing the convection section throughput with less control instability is possible. Without a stripping agent, increased input of heavy hydrocarbon feedstock can reduce the radiant section throughput because the higher flowrate of heavy hydrocarbon feedstock and steam does not heat up as much. The temperature drop resulting from the increased heavy hydrocarbon throughput not only reduces the fraction of hydrocarbon that vaporizes but can also reduce the total flowrate of hydrocarbon vapor. Higher vapor cut effected by the stripping agent mitigates this counter-intuitive convection/radiant feedrate effect.

The addition of a stripping agent can reduce the need for water and/or steam added at various points in the process, thereby reducing the fraction of the total furnace capacity which is used for boiling water and/or superheating steam. Reduced flash/separation vessel temperature requirements will allow efficient heating in the convection section to be balanced better with the heat needs of the radiant section, thereby reducing the need for heating excess air (generally monitored and reported in terms of excess oxygen). The additional capacity can be used to crack more feed. Reducing excess oxygen also improves furnace efficiency which can lead to a reduction in greenhouse gas emissions.

A 1% reduction in excess oxygen can result in about a 5 to 10% increase in furnace firing when the furnace is limited by stack inducted draft fan capacity. Such an increase in furnace firing allows increasing the maximum feedrate by about 5 to 10%. In one test, a reduction of excess oxygen from 6% to 3% made possible by mixing heavy atmospheric gas oil with atmospheric bottoms fraction (35/65 ratio) increased the maximum furnace feedrate by 20%.

While the present invention has been described and illustrated by reference to particular embodiments, those of ordinary skill in the art will appreciate that the invention lends itself to variations not necessarily illustrated herein. For this reason, then, reference should be made solely to the appended claims for purposes of determining the true scope of the present invention.

What is claimed is:

1. A process for cracking a heavy hydrocarbon feedstock, said heavy hydrocarbon feedstock comprising non-volatile components and/or coke precursors, and said process comprising:

(a) adding a stripping agent to the heavy hydrocarbon feedstock to form an enhanced hydrocarbon feedstock blend;

(b) heating said enhanced hydrocarbon feedstock blend;

(c) feeding the enhanced hydrocarbon feedstock blend to a flash/separation vessel;

(d) separating the enhanced hydrocarbon feedstock blend into a vapor phase and a liquid phase, said liquid phase being rich in non-volatile components and/or coke precursors and said vapor phase being substantially depleted of non-volatile components and/or coke precursors;

(e) removing the vapor phase from the flash/separation vessel;

(f) cracking the vapor phase in a radiant section of a pyrolysis furnace to produce an effluent comprising olefins, said pyrolysis furnace comprising a radiant section and a convection section.

2. The process of claim 1 wherein steam is added at any step or steps prior to step (f).

3. The process of claim 2, wherein the steam comprises sour or treated process steam.

4. The process of claim 2, wherein the steam is superheated in the convection section of the pyrolysis furnace.

5. The process of claim 2, wherein steam is added between steps (b) and (c).

6. The process of claim 2, wherein steam is added between steps (b) and (c) and the temperature of the enhanced hydrocarbon feedstock blend is at a first temperature from about 150 to about 340° C. (about 300 to about 650° F.) before mixing with the steam and the enhanced hydrocarbon feedstock blend is then further heated to a second temperature higher than the first temperature before step(c).

7. The process of claim 2, wherein steam is added to the vapor phase in the top portion of the flash/separation vessel.

8. The process of claim 2, wherein steam is added to the vapor phase downstream of the flash/separation vessel.

9. The process of claim 2, wherein the enhanced hydrocarbon feedstock blend is mixed with a fluid in addition to steam prior to step (d).

10. The process of claim 9, wherein the fluid comprises at least one of hydrocarbon and water.

11. The process of claim 10, wherein the fluid is water.

12. The process of claim 2, wherein steam is added to the vapor phase in the top portion of the flash/separation vessel.

13. The process of claim 1 wherein addition of the stripping agent enables cracking a higher fraction of the heavy hydrocarbon feedstock.

14. The process of claim 13 wherein addition of the stripping agent enables cracking at least about a 1% higher fraction of the heavy hydrocarbon feedstock as compared to the fraction of the heavy hydrocarbon feedstock cracked without adding the stripping agent.

15. The process of claim 14 wherein addition of the stripping agent enables cracking at least about a 10% higher fraction of the heavy hydrocarbon feedstock as compared to the fraction of the heavy hydrocarbon feedstock cracked without adding the stripping agent.

16. The process of claim 15 wherein addition of the stripping agent enables cracking at least about a 30% higher fraction of the heavy hydrocarbon feedstock as compared to the fraction of the heavy hydrocarbon feedstock cracked without adding the stripping agent.

17. The process of claim 1 wherein addition of the stripping agent reduces the coking rate in and downstream of said flash/separation vessel as compared to the coking rate when cracking the heavy hydrocarbon feedstock without adding the stripping agent.

18. The process of claim 1 further comprising quenching the effluent and recovering cracked product therefrom.

19. The process of claim 1 wherein said stripping agent reduces the $T_{50}$ of the enhanced hydrocarbon feedstock blend by at least about 15° C. (about 25° F.) from the $T_{50}$ of the heavy hydrocarbon feedstock.

20. The process of claim 19 wherein said stripping agent reduces the $T_{50}$ of the enhanced hydrocarbon feedstock blend by at least about 28° C. (about 50° F.) from the $T_{50}$ of the heavy hydrocarbon feedstock.

21. The process claim 1 wherein said stripping agent comprises from about 2 wt. % to about 95 wt. % of the enhanced hydrocarbon feedstock blend.

22. The process of claim 18 wherein said stripping agent comprises from about 10 wt. % to about 80 wt. % of the enhanced hydrocarbon feedstock blend.

23. The process of claim 19 wherein said stripping agent comprises from about 20 wt. % to about 50 wt. % of the enhanced hydrocarbon feedstock blend.

24. The process of claim 1 wherein said process results in an increase in capacity of the pyrolysis furnace as compared to using the heavy hydrocarbon feedstock without adding the stripping agent.

25. The process of claim 1 wherein said process results in at least about a 1% increase in capacity of the pyrolysis furnace as compared to using a feedstock comprising only the heavy hydrocarbon feedstock containing non-volatile components and/or coke precursors.

26. The process of claim 25 wherein said process results in at least about a 10% increase in the capacity of the pyrolysis furnace as compared to using a feedstock comprising only the heavy hydrocarbon feedstock containing non-volatile components and/or coke precursors.

27. The process of claim 26 wherein said process results in at least about a 20% increase in the capacity of the pyrolysis furnace as compared to using a feedstock comprising only the heavy hydrocarbon feedstock containing non-volatile components and/or coke precursors.

28. The process of claim 1, wherein the heavy hydrocarbon feedstock with non-volatile components and/or coke precursors comprises one or more of residues, crude oil, atmospheric pipestill bottoms, vacuum pipestill streams including bottoms, heavy non-virgin hydrocarbon streams from refineries, vacuum gas oils, atmospheric residue, low sulfur waxy residue, and heavy residue.

29. The process of claim 1, wherein the stripping agent comprises one or more of gas oils, heating oil, jet fuel, diesel, kerosene, gasoline, coker naphtha, steam cracked naphtha, catalytically cracked naphtha, hydrocrackate, reformate, raffinate reformate, Fischer-Tropsch liquids, Fischer-Tropsch gases, natural gasoline, distillate, virgin naphtha, wide boiling range naphtha to gas oil condensates, heavy gas oil, naphtha contaminated with crude, natural gas liquids, mixed C4 components, butanes, propane, ethane, and hydrocarbon gases.

30. The process of claim 29 wherein the stripping agent is contaminated with non-volatile components and/or coke precursors.

31. The process of claim 1 wherein the stripping agent comprises hydrogen.

32. The process of claim 1 wherein step (c) comprises introducing the enhanced hydrocarbon feedstock blend tangentially to the flash/separation vessel through at least one side inlet located in the side of said vessel.

33. The process of claim 1, wherein the enhanced hydrocarbon feedstock blend is heated by indirect contact with flue gas in a first convection section tube bank of the pyrolysis furnace before mixing with steam.

34. The process of claim 1, wherein the temperature of the enhanced hydrocarbon feedstock blend in step (c) is from about 315 to about 560° C. (about 600 to about 1040° F.).

35. The process of claim 1, wherein the pressure in step (d) is about 275 to about 1380 kPa (about 40 to about 200 psia).

36. The process of claim 1, wherein about 50 to about 98 percent of the enhanced hydrocarbon feedstock blend is in the vapor phase in step (e).

* * * * *